US011179020B2

(12) United States Patent
Spiessl et al.

(10) Patent No.: US 11,179,020 B2
(45) Date of Patent: Nov. 23, 2021

(54) DOMESTIC APPLIANCE WITH DOOR OPENER

(71) Applicant: emz-Hanauer GmbH & Co. KGaA, Nabburg (DE)

(72) Inventors: Georg Spiessl, Altendorf (DE); Albert Dirnberger, Neunburg vorm Wald (DE); Benjamin Schemela, Schwarzenbach (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 303 days.

(21) Appl. No.: 16/358,061

(22) Filed: Mar. 19, 2019

(65) Prior Publication Data

US 2019/0301230 A1 Oct. 3, 2019

(30) Foreign Application Priority Data

Mar. 29, 2018 (DE) ..... 102018002657.5
Nov. 12, 2018 (DE) ..... 102018008895.3

(51) Int. Cl.
*E05F 15/627* (2015.01)
*A47L 15/42* (2006.01)
(Continued)

(52) U.S. Cl.
CPC ..... *A47L 15/4259* (2013.01); *A47L 15/4261* (2013.01); *A47L 15/4263* (2013.01); *D06F 39/14* (2013.01); *D06F 58/20* (2013.01); *E05F 3/00* (2013.01); *E05F 15/619* (2015.01); *E05F 15/627* (2015.01); *E05Y 2201/604* (2013.01); *E05Y 2900/304* (2013.01); *E05Y 2900/312* (2013.01)

(58) Field of Classification Search
CPC ..... E05F 15/627
See application file for complete search history.

(56) References Cited

U.S. PATENT DOCUMENTS 7,896,972 B2 3/2011 Berends et al.
2016/0351881 A1 9/2016 Dirnberger et al.

FOREIGN PATENT DOCUMENTS

CN 103966810 A 8/2014
CN 206337971 U 7/2017
(Continued)

OTHER PUBLICATIONS

CN Office Action with English translation in co-pending application CN 201910156007.5, dated Nov. 24, 2020.

*Primary Examiner* — Jason Y Ko
(74) *Attorney, Agent, or Firm* — Hayes Soloway PC

(57) ABSTRACT

A domestic appliance, for example a washing machine, comprises a body having an access opening to a process chamber arranged inside the body, a door which is movably attached to the body and which closes the access opening in a closed position, a door-closing mechanism for holding the door closed in its closed position and a door-opening mechanism arranged on the body or on the door, having a push slider, which is movable between a retracted position and a deployed position, and a drive unit for driving the push slider. A transfer of the push slider out of the retracted position into the deployed position effects opening of the closed door, the push slider acts in a pressure-exerting manner on the door or on the body and thereby overcomes a holding-closed action of the door-closing mechanism and opens the closed door.

21 Claims, 13 Drawing Sheets

(51) Int. Cl.

| | |
|---|---|
| ***E05F 3/00*** | (2006.01) |
| ***E05F 15/619*** | (2015.01) |
| ***D06F 39/14*** | (2006.01) |
| ***D06F 58/20*** | (2006.01) |

(56) References Cited

FOREIGN PATENT DOCUMENTS

| | | | |
|---|---|---|---|
| CN | 107120016 | A | 9/2017 |
| DE | 102013223431 | B3 | 11/2014 |
| DE | 102015002538 | B3 | 3/2016 |
| EP | 1733675 | A2 | 12/2006 |
| EP | 2210547 | A1 | 7/2010 |
| KR | 20060074843 | A | 7/2006 |
| WO | 2011003714 | A1 | 1/2011 |
| WO | 2015071157 | A1 | 5/2015 |

DOMESTIC APPLIANCE WITH DOOR OPENER

BACKGROUND OF THE INVENTION

1. Field of the Invention

The present invention relates generally to a domestic appliance having a door-opening function

2. Description of the Prior Art

The usual equipment of modern households includes a wide variety of appliances which have a process chamber arranged inside an appliance body, as well as a door by means of which an access opening to the process chamber can be closed. In the process chamber, objects can be subjected to a treatment process, for example cleaning or cooking. Examples of such appliances are accordingly a washing machine, a tumble dryer, a dishwasher, an oven and the like. In particular in the case of those domestic appliances in which there is a comparatively large amount of moisture in the process chamber at the end of a program run, either in the form of hot steam, for example, in the case of a dishwasher or in the form of wet laundry in the case of a washing machine, it is sometimes desirable to be able to partially open the door automatically, in order, for example in the case of a dishwasher, to accelerate drying of the still wet dishes or, in the case of a washing machine, to avoid a musty odour of the wet washing if it is left too long in the washing machine in the wet state. Mechanisms for achieving an automatic door-opening function in a domestic appliance have variously been demonstrated in the prior art. By way of example, reference is made to EP 1 733 675 A2, WO 2011/003714 A1, EP 2 210 547 A1 and WO 2015/071157 A1.

In some domestic appliances, the available installation space may be insufficient to accommodate therein a pusher which is movable linearly between a retracted position and a deployed position and, when moved into its deployed position, causes the door to be pushed open. For the desired partial opening of the door, a movement stroke of the pusher of several centimetres may be required, which may not be available in some domestic appliances owing to the structural conditions. For example, in the case of washing machines, the concrete weights typically present therein, which are to serve to reduce occurring vibrations, may stand in the way of the installation of a pusher which is to be linearly movable over a distance of, for example, 5 or more centimetres.

SUMMARY OF THE INVENTION

It is an object of the present invention to provide a domestic appliance having a door-opening mechanism which is suitable also for confined installation conditions.

In achieving this object, the invention starts, according to a first aspect, from a domestic appliance which comprises: a body having an access opening to a process chamber, in particular a wet chamber, arranged inside the body, wherein the body forms a first main component of the domestic appliance; a door which is movably attached to the body and which, in a closed position, closes the access opening, wherein the door forms a second main component of the domestic appliance; a door-closing mechanism for holding the door closed in its closed position; and a door-opening mechanism arranged on one of the two main components and having a push slider, which is movable along a slide path between a retracted position and a deployed position, and a drive unit for driving the push slider. As it moves from the retracted position into the deployed position, the push slider acts in a pressure-exerting manner on the other of the two main components and thereby overcomes a holding-closed action of the door-closing mechanism and opens the closed door. According to the invention, the slide path has at least one curved portion, wherein at least a section of the push slider is in flexible form in order to follow the curved profile of the curved portion as the push slider moves along the slide path.

In the solution according to the invention, the flexible form of the push slider in at least a section thereof permits a curved movement of the push slider when it is moved out of its retracted position into the deployed position. On installation of the door-opening mechanism, the possibility of a curved movement of the push slider provided by the flexible section facilitates adaptation to the available, possibly confined space conditions within that of the two main components of the domestic appliance on which the door-opening mechanism is to be arranged. For example, in the case of a washing machine, the door-opening mechanism can be accommodated in the body of the washing machine despite the presence of bulky concrete weights, without having to accept limitations as regards the stroke length between the retracted position and the deployed position of the push slider.

The flexibility of the section of the push slider can be due to elastic bendability or/and to articulation. For example, the push slider can have one or more portions which are manufactured from an elastic material and are therefore elastically deformable. Alternatively or in addition, the push slider can have a plurality of elements which are articulated with one another and impart flexibility to the push slider as a whole on account of the articulated connection. The elements as such can be rigid or possess inherent elasticity.

In some embodiments, the curved portion effects a change of direction of the sliding movement of the push slider by approximately 90 degrees.

In some embodiments, the push slider has a leading portion which moves out of one main component in a first direction when the push slider is transferred from the retracted position to the deployed position, and a rearward portion which performs a linear movement in a second direction running transversely, in particular perpendicularly, to the first direction when the push slider is transferred from the retracted position into the deployed position.

In some embodiments, the rearward portion is rigid compared to the flexible section of the push slider.

In some embodiments, the flexibility extends into a region of the push slider which protrudes from one main component in the deployed position. In particular, the flexibility can extend over a major part of the length of a section of the push slider which protrudes from one main component in the deployed position.

In some embodiments, the door-opening mechanism forms in the curved portion a slideway on the inside of the curve and a slideway on the outside of the curve for guiding the push slider in a curve.

In some embodiments, the flexible section of the push slider is formed by a push member string which has a plurality of, for example, at least 10 or at least 20 or at least 30 push members which are movable relative to one another and are arranged one behind the other in the direction of movement of the pusher in such a manner that they are capable of transmitting a pushing force.

In some embodiments, a section of the push slider protrudes in the deployed position thereof from one of the two main components, wherein that section has a plurality of at least 3 or at least 5 or at least 7 push members of the push member string, for example more than 10 push members.

In some embodiments, the push members of the push member string are pretensioned relative to one another by spring-elastic pretensioning means. According to some embodiments, the pretensioning means can comprise at least one coil spring element, onto which at least a partial number of the push members of the push member string are threaded. In some embodiments, the coil spring element extends over substantially the entire string length of the push member string.

In some embodiments, the push slider has a toothed-rack element arranged in the force transmission path between the drive unit and the flexible section and coupled in a push-transmitting manner with the flexible section, with which toothed-rack element a rotary element of the drive unit is in intermeshing engagement.

In the case of the first aspect of the invention, the door-opening mechanism is in some embodiments arranged on the body. However, it is possible within the context of the present disclosure alternatively to arrange the door-opening mechanism on the appliance door of the domestic appliance, so that the push slider moves out of the door and pushes against the body.

According to a further aspect, the invention provides a domestic appliance comprising a body having an access opening to a process chamber, in particular a humid or wet chamber, arranged inside the body, a door which is movably attached to the body and which frees the access opening in an open position and closes the access opening in a closed position, a door-closing mechanism for holding the door closed in its closed position, and a door-opening mechanism having a push slider, which is arranged to be movable between a retracted position and a deployed position, and a drive unit for driving the push slider, wherein a transfer of the push slider out of the retracted position into the deployed position effects opening of the closed door. According to the invention, the push slider and its drive unit are arranged on the door, wherein the push slider protrudes from the door at least in the deployed position. The invention according to this second aspect takes advantage of the finding that, at least in some domestic appliances, the space conditions in the door may be better suitable than those in the body of the domestic appliance for the installation of a door-opening mechanism. In particular in the case of washing machines of the front loader type (with a bull eye door arranged on a front side of the appliance), the available space in the body directly behind the door is sometimes so limited that the door is better suitable for the installation of the door-opening mechanism.

In some embodiments, the door-closing mechanism comprises a closing body arranged on the door and a latch assembly arranged on the body. When the door closes, the closing body enters an entry opening of the latch assembly and comes into closing engagement with a movable component of the latch assembly. For example, the closing body can be in the form of a closing stirrup which is gripped and held behind the entry opening by a rotatably arranged gripping element of the latch assembly. Alternatively, the closing body can be in the form of a pivotable closing hook, for example, which, after passing through the entry opening, comes into hooking engagement with a linearly movable slider of the latch assembly. In such embodiments, it is conceivable in the case of the second aspect of the invention that the push slider is formed by the closing body, that is to say that the closing body itself serves as the push slider and is movable by means of the drive unit between a retracted position and a deployed position. The closing engagement between the closing body and the movable component of the latch assembly can remain unaffected by a forward movement of the closing body out of the retracted position into the deployed position. For example, at the end of a wash program of a washing machine or at the end of a drying program of a tumble dryer, the closing body can automatically be moved forward (into the deployed position) to such an extent that the door is opened slightly and an exchange of air between the process chamber and the external environment of the domestic appliance is possible. The closing engagement between the closing body and the latch assembly can then later be released by the user in the conventional manner, for example by pulling on the door or by actuating a hinged flap attached to the door.

In other embodiments, the push slider is a component that is separate from the door-closing mechanism and does not take part in the closing function of the door-closing mechanism. In the case of the second aspect of the invention, the push slider can then act in a pressure-exerting manner on the body or on a component arranged on the body as it moves out of the retracted position into the deployed position, whereby it overcomes a holding-closed action of the door-closing mechanism and opens the closed door. The push slider can, for example, push against a fixed contact surface arranged on the body, for example against the outside of a wall portion of a body housing extending all round the access opening. Alternatively, the push slider can cooperate with a movable component arranged on the body, which movable component can grip and hold the push slider as the door closes. Such a configuration can be used not only to open the door by sliding the push slider forwards, but subsequently to close the door again by retraction of the push slider. In some embodiments, a gripping element that is mechanically and physically separate from the door-closing mechanism is therefore arranged on the body, which gripping element, when the door is closed and when the push slider is moved forwards out of the retracted position into the deployed position, maintains a gripping engagement with the push slider so that the maintained gripping engagement has the effect that the door closes again when the push slider is subsequently retracted.

In some embodiments of the second aspect of the invention, the push slider is arranged to be movable along a slide path which is exclusively linear and in particular runs substantially perpendicularly to a door plane. In these embodiments, the push slider can be formed by a body that is rigid overall and does not require a flexible section for moving in a curved path as in the first aspect according to the invention.

In the second aspect of the invention too, the push slider can have a toothed-rack region with which a rotary element of the drive unit is in intermeshing engagement.

In some embodiments of the first or/and second aspect of the invention, the drive unit comprises an electric drive motor and, if desired, a reduction gear, whereby it is possible within the context of the present disclosure to choose a drive unit that operates by a different drive principle (e.g. wax motor, electromagnet).

In some embodiments of the first or/and second aspect of the invention, a slip clutch is arranged in the force transmission path between a driving force generator of the drive unit and the push slider. The slip clutch can prevent damage to the driving force generator (e.g. drive motor) if, despite activation of the door-opening mechanism, the door cannot be opened, for example because a user is inadvertently pushing against the door or because there is a heavy weight in front of the door.

In some embodiments, the domestic appliance is a washing machine, a tumble dryer or a dishwasher. In some exemplary embodiments, the domestic appliance is a laundry treatment appliance having a drum that is driven in rotation, the drum interior of which forms the process chamber.

The invention will be explained in greater detail hereinbelow with reference to the accompanying drawings.

DETAILED DESCRIPTION OF THE INVENTION

Figure 1:
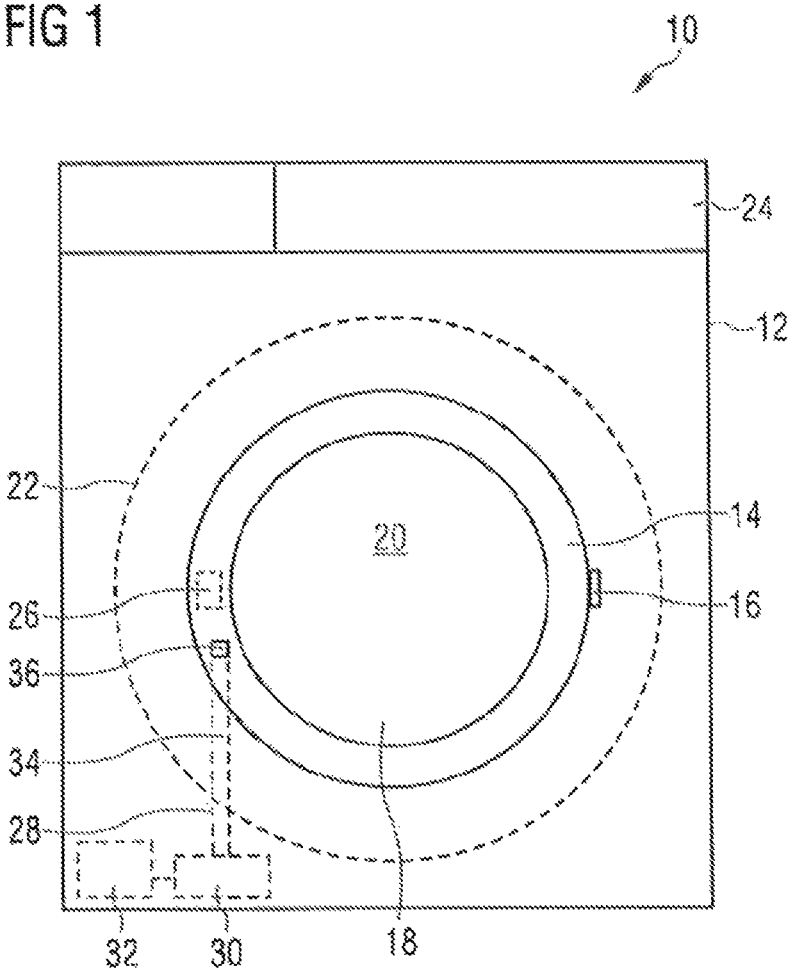
FIG. 1 shows, schematically, a domestic washing machine according to an exemplary embodiment.

The preferred embodiments of the present invention are illustrated in FIGS. 1-13. Reference will first be made to FIG. 1. The domestic washing machine shown therein is designated generally 10. It is representative of the large number of different types of domestic appliances which can be equipped with a door-opening mechanism according to the invention. The washing machine 10 has a body 12 to which a door 14 is pivotably attached. A pivot hinge is shown schematically at 16, by means of which hinge the door 14 is mounted on the body 12. A bull eye 18 (as is conventional in washing machines of the front loader type) in the door 14 allows the user to see into the washing chamber (process chamber) designated 20, in which the laundry to be cleaned is situated. The washing chamber 20 is formed in a washing drum 22, indicated by means of a broken line, which is rotatably mounted in a suds container, not shown in greater detail.

On the front side of the washing machine 10 facing towards the user, above the door, there is formed an operating region 24 with the operating members (not shown in greater detail) required for operating the washing machine 10. In addition to the conventional control operating members, by means of which the user can set different wash programs, the operating region 24 also comprises one or more detergent drawers into which the user can introduce the desired cleaning substances.

The washing machine 10 further comprises a door-closing mechanism, indicated schematically at 26, which holds the door 14 closed. The door-closing mechanism 26 can apply a holding-closed force which is greater than the restoring force of a door seal, not shown in greater detail in FIG. 1 but generally conventional in domestic washing machines, which is compressed as the door 14 is closed. The door-closing mechanism 26 can be of the conventional type; for example, the door-closing mechanism 26 can comprise a door latch with a cinching function, that is to say a door latch which contains one or more closing springs which relax as the door 14 is closed and thereby exert a cinching action on the door 14 which assists the work of the user. An example of a configuration of the door-closing mechanism 26 is described in DE 10 2015 002 538 B3.

The washing machine 10 additionally comprises a door-opening mechanism, indicated at 28 by a broken line, the purpose of which is to open the door 14 slightly (i.e. partial opening) on completion of a wash program, so that fresh ambient air is able to reach the wet or damp laundry in the wash chamber 20 and the development of musty odours is thereby prevented, which can otherwise occur if the wet or damp laundry remains too long in the washing machine 10 with the door 14 closed. The door-opening mechanism 28 comprises a controllable drive unit 30 which is in electrical control connection with a control unit 22 controlling the operation of the washing machine 10. By providing an automated door-opening function, the user of the washing machine 10 is relieved of the effort of having to monitor the progress of an ongoing wash program himself in order to be able to open the door 14 promptly once the program has ended.

In the example shown, the door-opening mechanism 28 is a mechanism which is physically and mechanically separate from the door-closing mechanism 26; both mechanisms 26, 28 are each functional mechanisms in their own right which do not depend on one another in respect of their mechanical functionality.

The door-opening mechanism 28 comprises a push slider in mechanical drive connection with the drive unit 30, which push slider is indicated at 34 by a broken line in FIG. 1 and can be moved by actuation of the drive unit 30 from a retracted position into a deployed position. At its leading end, the push slider 34 forms a push button 36 with which the push slider 34 pushes against a suitable contact surface in order to open the door 14. In the example shown, the door-opening mechanism 28 is arranged with the drive unit 30 and the push slider 34 on the body 12 of the washing machine 10, so that the mentioned contact surface is located on the door 14, that is to say the push slider 34 pushes with its push button 36 against the door 14. The pushing force generated by the drive device 30, with which it pushes the push slider 34 forwards, is sufficient to overcome the holding-closed force of the door-closing mechanism 26, that is to say the force that a user would have to apply in order to pull the closed door open 14 by hand. In the case of a configuration of the door-closing mechanism 26 as a push-push latch, in which not only closing of the door 14 but also normal opening of the door 14 is effected by a pushing operation on the part of the user, as described, for example, in DE 10 2007 009 539 B3, the holding-closed force to be overcome by the door-opening mechanism 28 is the force which would have to be applied for emergency opening of the door by pulling the door open.

Figure 2:
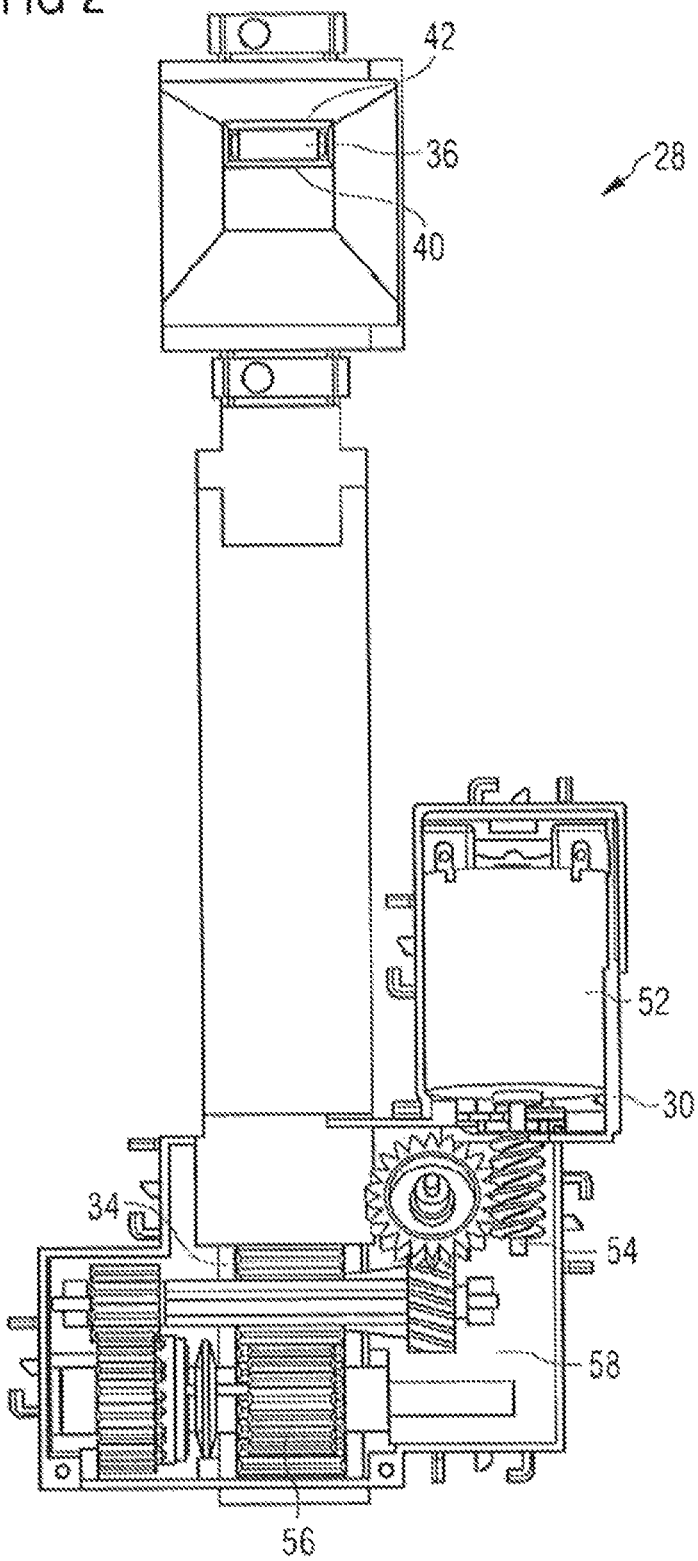
FIGS. 2 and 3 are different views of a door-opening mechanism according to an exemplary embodiment installed in the washing machine of FIG. 1.
Figure 3:
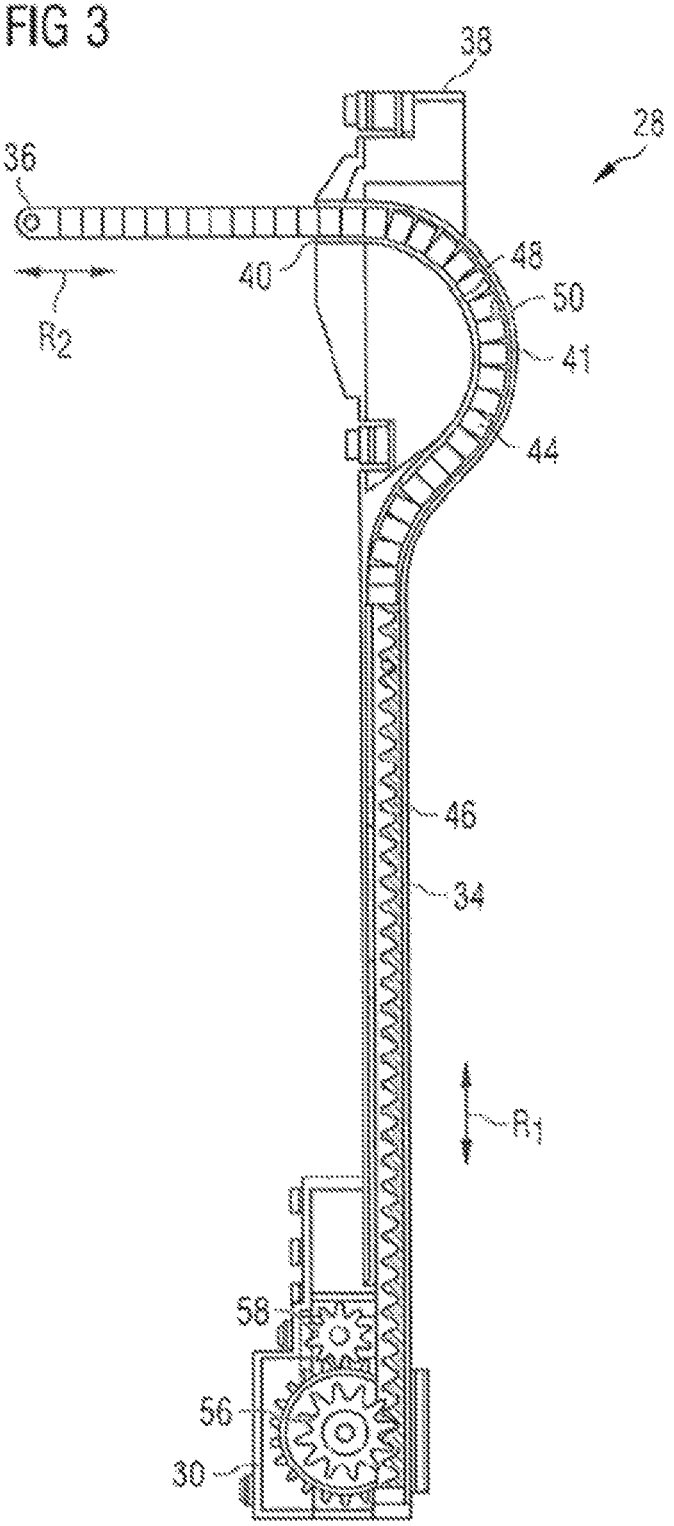
Figure 4:
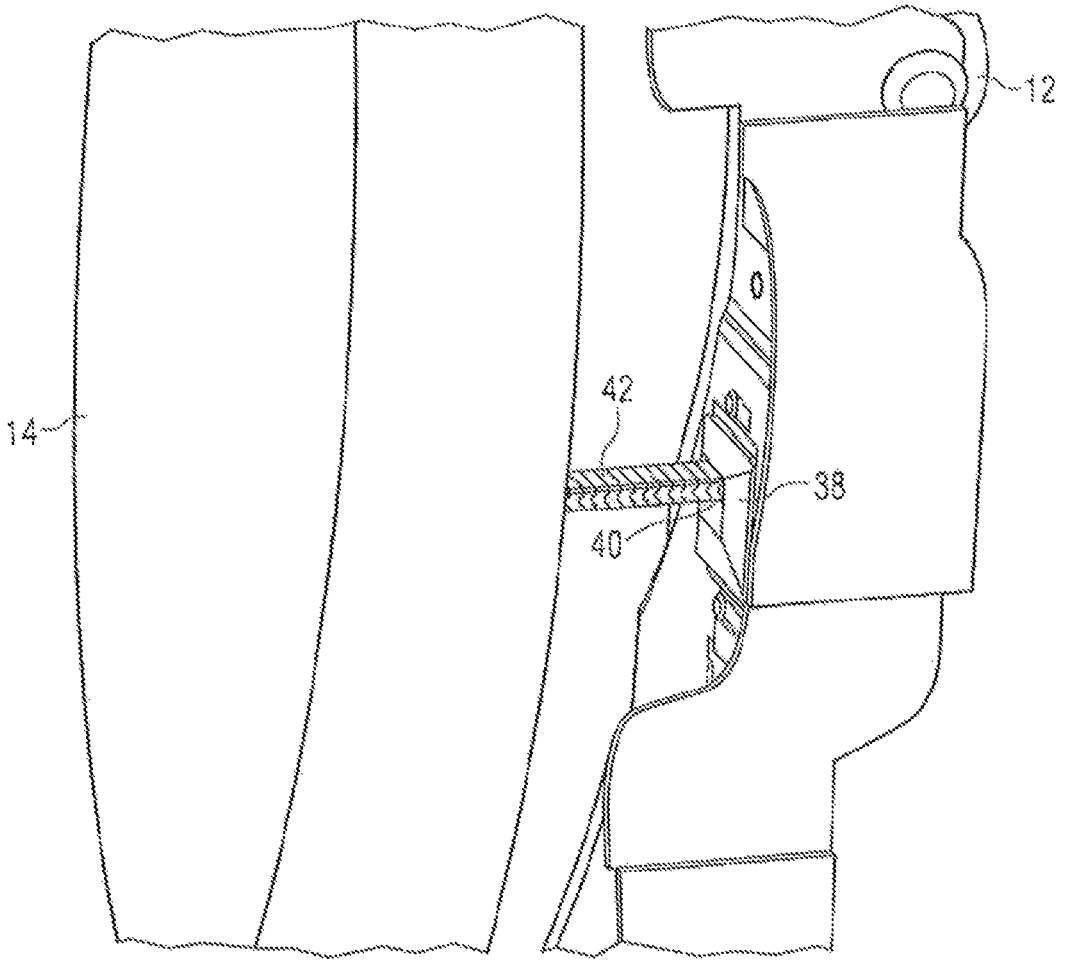
FIG. 4 is a view showing how the door-opening mechanism of FIGS. 2 and 3 pushes a door open.

Reference will now additionally be made to FIGS. 2 and 3. In these figures, various components of the door-opening mechanism 28 are shown in greater detail. The door-opening mechanism 28 comprises a housing structure 38 in which the various movable components of the door-opening mechanism 28 are accommodated. The housing structure 38 allows the door-opening mechanism 28 to be assembled as a pre-mounted structural unit which is mechanically functional in itself and which, as such, can be mounted on the body 12 of the washing machine 10, for example on a body front wall, in front of which the user stands during normal use of the washing machine 10. The housing structure 38 forms an exit opening (at 40), from which the push slider 34 emerges as it moves out of its retracted position into the deployed position.

In the retracted position, the push button 36 is in some embodiments fully recessed inside the housing structure 38, that is to say does not protrude from the exit opening 40. In the deployed position, the push slider 34 protrudes from the exit opening 40 by a few centimetres, for example at least 3 cm or at least 4 cm or at least 5 cm. For the movement stroke of the push slider 34 that is required therefor, there is insufficient installation space in some washing machines behind the body front wall in the depth direction of the washing machine, that is to say perpendicularly to the body front wall. Therefore, in the exemplary embodiment of the door-opening mechanism 28 that is shown, the push slider 34 is not formed entirely by a rigid linear slider but contains a flexible section 41, which in the example shown is formed by a push member string 42 which is composed of a plurality of push members 44 arranged one behind the other in the sliding direction of the push slider 34. The push member string 42 reaches into the region of the leading end of the push slider 34; in the example shown, the push button 36 is formed by the forwardmost push member 44 of the push member string 42 in the deployment direction of the push slider 34. At its rear end—again viewed in the deployment direction of the push slider 34—the push member string 42 is coupled with a rigid rod element 46 which is resistant to bending and has a tooth system over at least a portion of its rod length. Therefore, the rod element 46 will also be referred to hereinbelow as a toothed-rack element, even though the tooth system is not intended to extend over the entire rod length.

The toothed-rack element 46 is guided in the housing structure 38 in a linearly movable manner in a direction $R_1$ (FIG. 3). The direction in which the push button 36 moves when the push slider 34 is deployed is a linear direction $R_2$, which runs transversely (in the example shown perpendicularly) to the direction $R_1$. The direction $R_1$ is a direction parallel or at least approximately parallel to the wall plane of the body front wall, in which the access opening, closable by means of the door 14, to the wash chamber 20 is formed. The direction $R_2$ is a direction transverse, in particular perpendicular, to the wall plane of the body front wall. The flexible section 41 (here: the push member string 42) makes a change of direction from direction $R_1$ to direction $R_2$ possible. For that purpose, the housing structure 38 of the door-opening mechanism 28 forms a bent slide guide (curved guide) with a radially inner slideway 48 (on the inside of the curve) and a radially outer slideway 50 (on the outside of the curve), which delimit between them a guiding receiving space for the flexible section 41. The change in direction effected by the slideways 48, 50 corresponds in the example shown to a 90° deflection.

It will be seen in FIG. 3 that the deflection region formed by the slideways 48, 50 requires an installation depth in the direction $R_2$ which is smaller than the degree by which the push button 36 protrudes relative to the exit opening 40 in the deployed position of the push slider 34. In order to illustrate this by means of a numerical example, it is assumed that the deployment path of the push slider 34 is approximately 5 cm, in order to move it out of the retracted position into the deployed position. In the deployed position, the push button 36 therefore projects from the exit opening 40 by approximately 5 cm. By contrast, an installation depth in the direction $R_2$ of, for example, approximately 2 to 3 cm can be sufficient to accommodate the curve guide (formed by the slideways 48, 50). This allows the door-opening mechanism 28 to be installed in an installation environment in which an installation space having a depth in the direction $R_2$ that corresponds to the required deployment distance of the push slider 34 between the retracted and the deployed position (in the assumed numerical example 5 cm) is not available behind the body front wall, for example because of the presence of concrete weights.

The drive unit 30 is an electromotive drive unit with an electric motor 52, the drive shaft 54 of which is in drive connection with a pinion 56 which is located at the output-side end of a multi-wheel reduction gear 58 and is in intermeshing engagement with the tooth system of the toothed-rack element 46.

The push member string 42 is sufficiently fine to permit the desired movability in a curve with a comparatively small curve radius. In the example shown, the push member string 42 is composed of several tens of push members 44 (here: over 30), which can be, for example, in lamellar or block form. In the deployed position of the push slider 34, a section of the push member string 42, which contains more than 5 or more than 8 or more than 10 push members 44 (in the example shown: 13 push members), protrudes from the exit opening 40 of the housing structure 38, see also the representation of FIG. 4. The small size of the individual push members 44 (compared to the total length of the push member string 42) and the associated comparatively large number of push members 44 which protrude from the exit opening 40 in the deployed position of the push slider 34, are advantageous for the tendency of the protruding section of the push member string 42 to bend to the side in the case of lateral loading, for example if a user strikes the protruding section of the string 42 with his hand, which can prevent possible injury. In contrast to the multi-membered section of the push member string 42 which protrudes from the exit opening 40 in the deployed position, a user could easily injure himself on a rigid, one-piece slide if he accidentally knocked against it.

On the other hand, the push member string 42, when oriented linearly, provides high bending stability when a pushing force acts thereon in the longitudinal direction of the string 42. This bending stability is achieved by suitable shaping of the individual push members 44, which interengage under a pushing load, for example, with a mutual centring function. Since, when the door 14 is pushed open by means of the push slider 34, substantially only pushing forces in the longitudinal direction of the string act on the push member string 42, there is no risk that the (linearly oriented) section of the push member string 42 protruding from the exit opening 40 will bend to the side—as long as it is not exposed to additional lateral loads, for example by the hand of a user.

Figure 5:
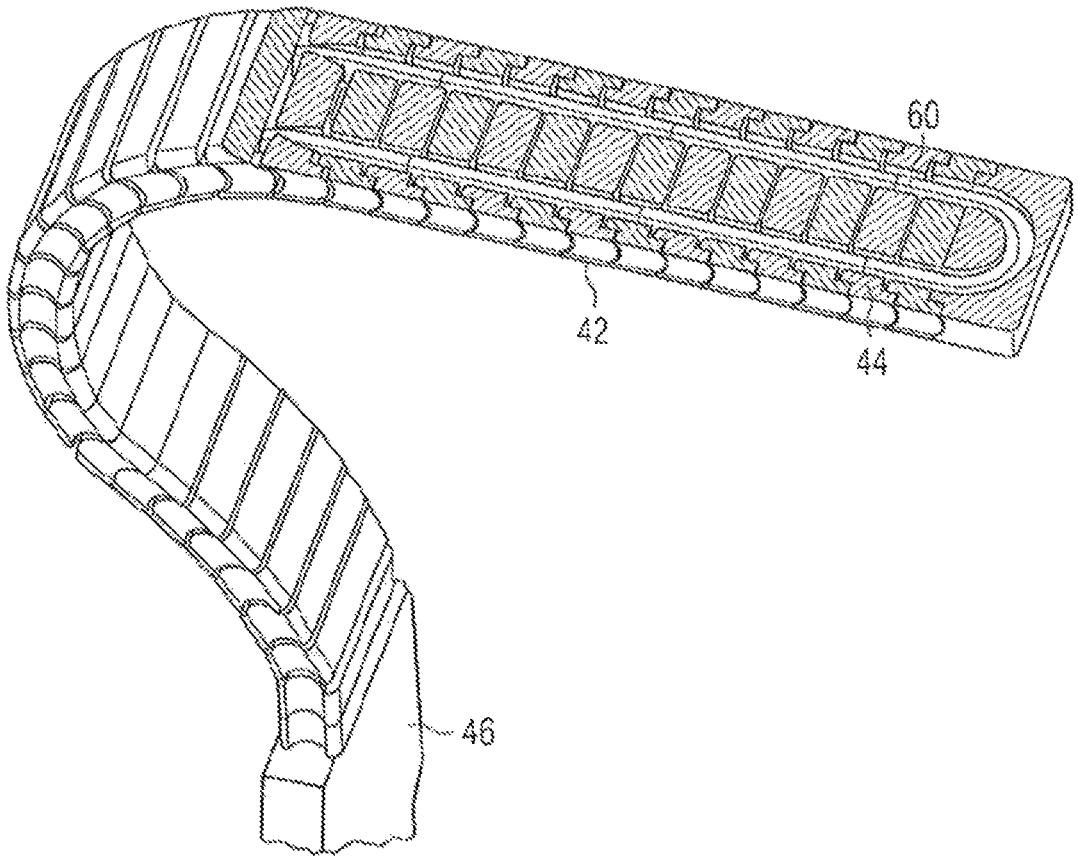
FIGS. 5 and 6 are views of a push member string contained in the door-opening mechanism of FIGS. 2 and 3.
Figure 6:
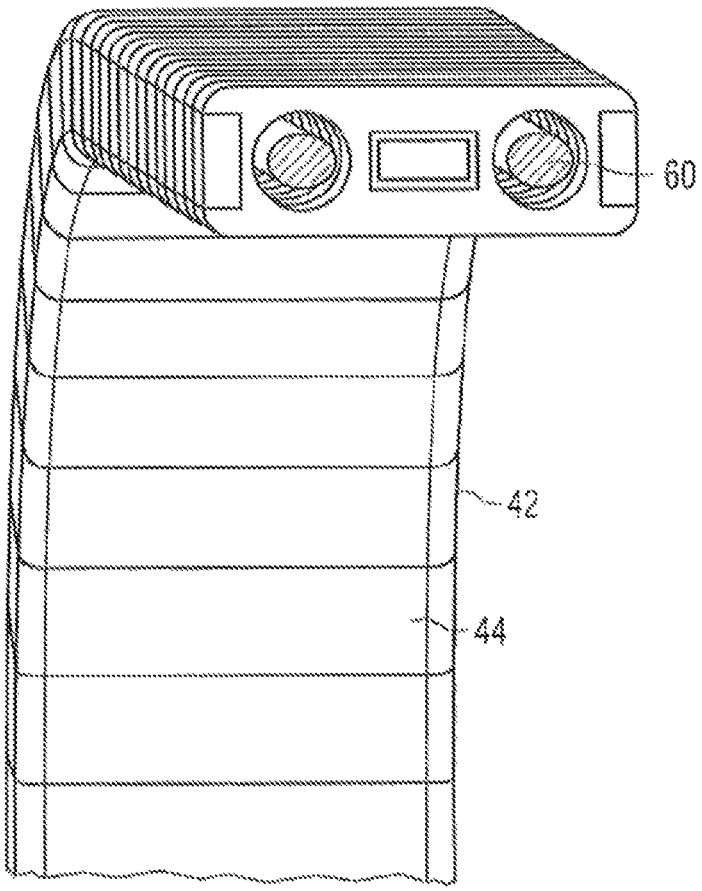

Reference will now additionally be made to FIGS. 5 and 6. In the push member string 42, the push members 44 are movable relative to one another, which imparts flexibility to the string as a whole. In addition, they are pretensioned relative to one another, for which reason the push members 44 pile up in mutual contact in a rest state and the string 42 would orient itself linearly in the absence of a force acting thereon. For mutual pretensioning, there is used in the example shown, in the push member string 42, at least one elongate pretensioning element 60 which connects all the push members 44 of the string 42 together. The pretensioning element 60 is stretch-elastic, that is to say it can be stretched elastically in the longitudinal direction of the string. For example, the pretensioning element 60 is in the form of a coil spring; alternatively, it is conceivable to use a rubber-elastic band for the pretensioning element 60. It will be seen in FIG. 6 that the individual push members 44 are threaded loosely onto the pretensioning element 60 one behind the other and accordingly are movable relative to the pretensioning element 60. In the example shown according to FIG. 5, the pretensioning element 60 is laid double and extends with each of its halves over the entire length of the push member string 42. Instead of such a doubly laid pretensioning element 60, it is of course possible to use two separate pretensioning elements 60, each of which reaches from one end of the push member string 42 to the other end.

In the further figures, elements which are the same or have the same effect are provided with the same reference numerals as in the preceding figures, but with the addition of a lowercase letter. Unless indicated otherwise hereinbelow, reference is to be made to FIGS. 1 to 6 for the explanation of such elements.

The exemplary embodiments of FIGS. 7 to 10 differ from the exemplary embodiment of FIGS. 2 to 6 in each case by a different form of the flexible section 41 of the push slider 34. In the exemplary embodiment according to FIG. 7, the flexible section 41*a* of the push slider 34*a* is formed by an elastically bendable rod body 62*a*, which is coupled with the toothed-rack element 46*a* in such a manner as to transmit pushing forces. The rod body 62*a* is sufficiently bendable to adapt to the curved profile of the curved guide defined by the slideways 48*a*, 50*a*. At the same time, it is sufficiently bend-proof that it will not bend in the section projecting from the exit opening 40*a* in the deployed position when pressure is exerted on the door of the washing machine. The rod body 62*a* can be manufactured, for example, from a rubber material.

Figure 7:
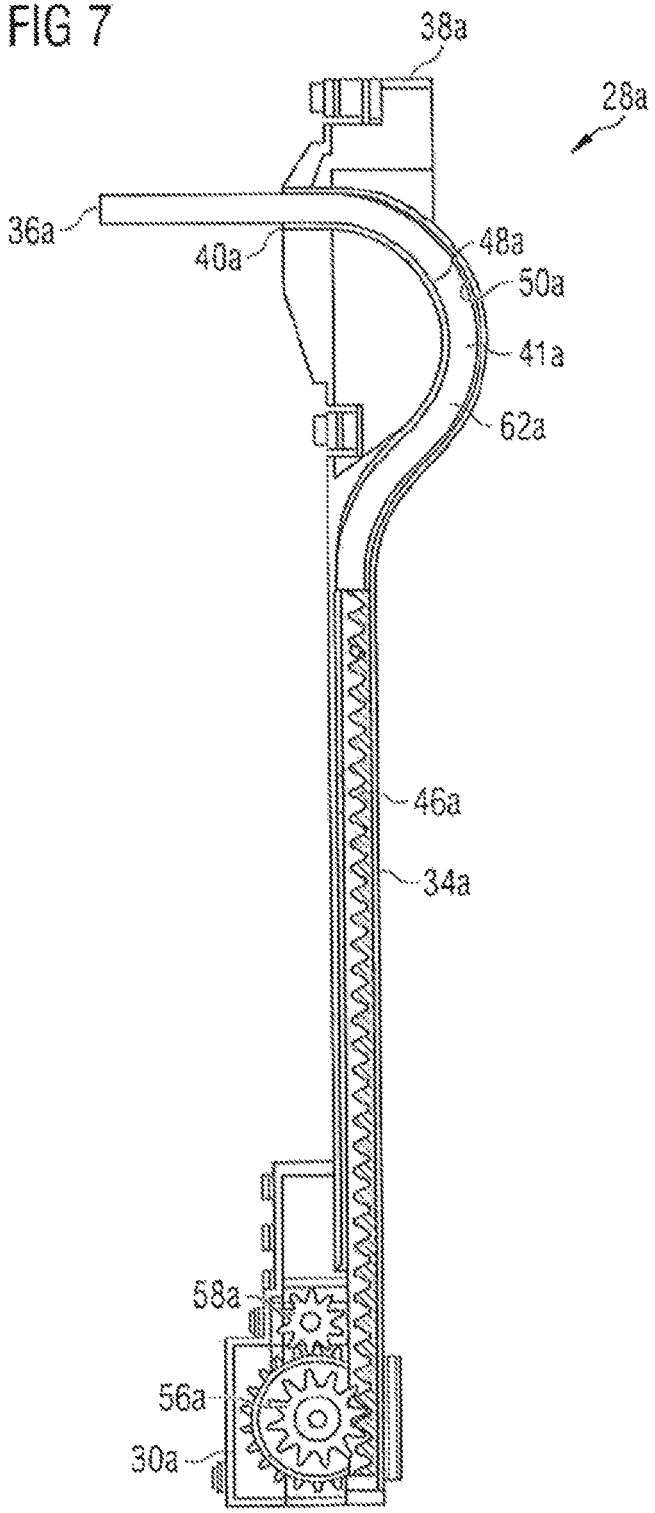
FIGS. 7 to 10 are views corresponding to FIG. 3 of further exemplary embodiments of a door-opening mechanism.
Figure 8:
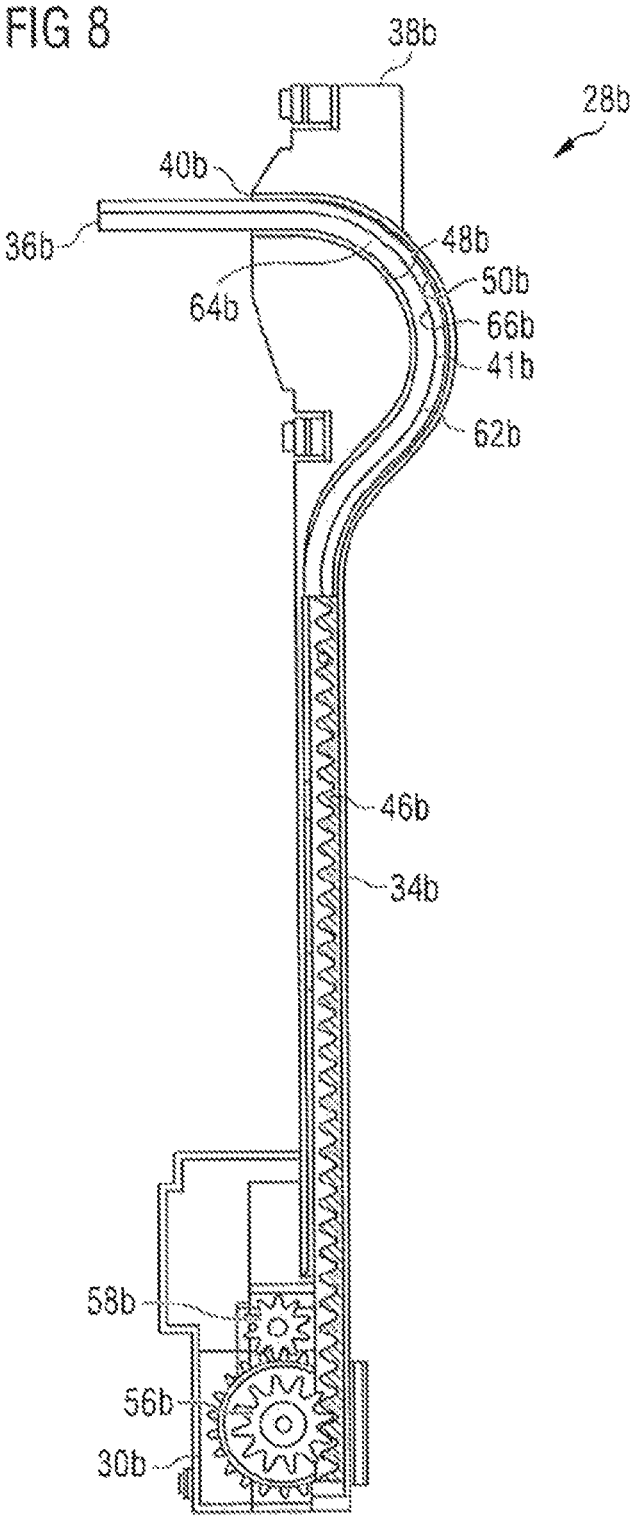

In the exemplary embodiment according to FIG. 8, the flexible section 41*b* of the push slider 34*b* is formed by an elastically bendable rod body 62*b* which, in contrast to the rod body 62*a* of the exemplary embodiment of FIG. 7, is in the form of a multi-component body. The multi-component rod body 62*b* has a plurality of material layers (in the example shown: two) each having different material properties. A first material layer is designated 64*b* in FIG. 8, while a second material layer is designated 66*b*. The material layer 64*b* forms a material layer on the inside of the curve, while the material layer 66*b* forms a material layer on the outside of the curve. The two material layers 64*a*, 66*b* can be produced, for example, integrally in one piece in a two-component injection moulding process or in a two-component extrusion process. The material layer 64*b* on the inside of the curve is formed of a rubber material, for example, while the material layer 66*b* on the outside of the curve is formed by a thermosetting or thermoplastic plastics material. For example, the material layer 66*b* on the outside of the curve is manufactured from the same plastics material as the toothed-rack element 46*b*, but the material layer 66*b* on the outside of the curve has a smaller material thickness than the toothed-rack element 46*b* and, owing to the smaller material thickness, is able to cling elastically to the curved profile of the slideways 48*b*, 50*b*. In the example shown, the rubber layer 64*b* on the inside of the curve is thicker than the plastics layer 66*b* on the outside of the curve. The multi-layer nature of the rod body 62*b* can be helpful for optimising the rod body 62*b* in respect of the requirements of the bending resistance of the section of the rod body 62*b* that protrudes from the exit opening 40*b* and the flexibility of the rod body 62*b* when it moves along the bent slideways 48*b*, 50*b*.

Figure 9:
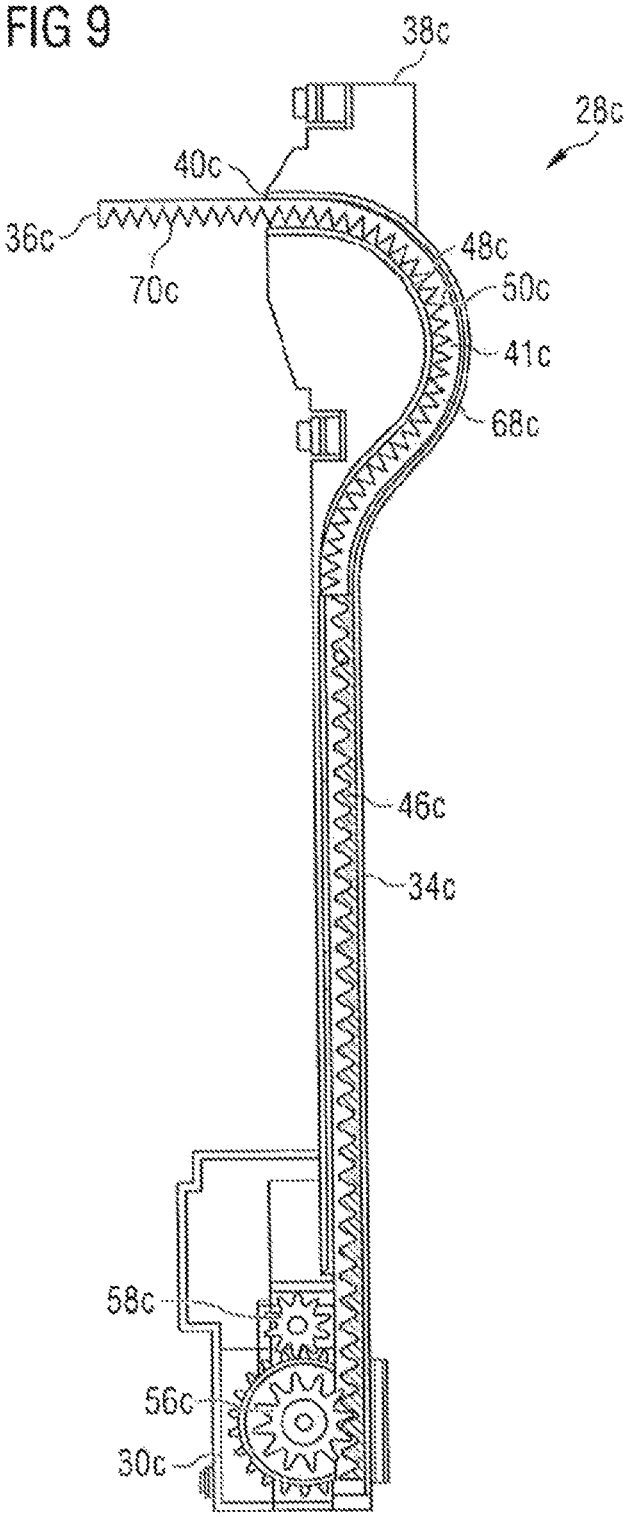

In the exemplary embodiment according to FIG. 9, the flexible section 41*c* of the push slider 34*c* is formed by a rod body 68*c* which is designed with a tooth system 70*c*, which imparts to the rod body 68*c* the desired flexibility to be able to follow the curved profile of the slideways 48*c*, 50*c*. In the example shown, the tooth system 70*c* is located on a side of the rod body 68*c* facing the slideway 48*c* on the inside of the curve. It will be appreciated that, as an alternative, the tooth system 70*c* can be formed on a side of the rod body 68*c* facing the slideway 50*c* on the outside of the curve. The reduced material thickness in the region between successive teeth of the tooth system 70 imparts the desired flexibility to the rod body 68*c*. It is therefore not necessary to manufacture the rod body 68*c* from a rubber-elastic material. Instead, a plastics material which as such has no or at most only slight elasticity can be used for the rod body 68*c*.

Figure 10:
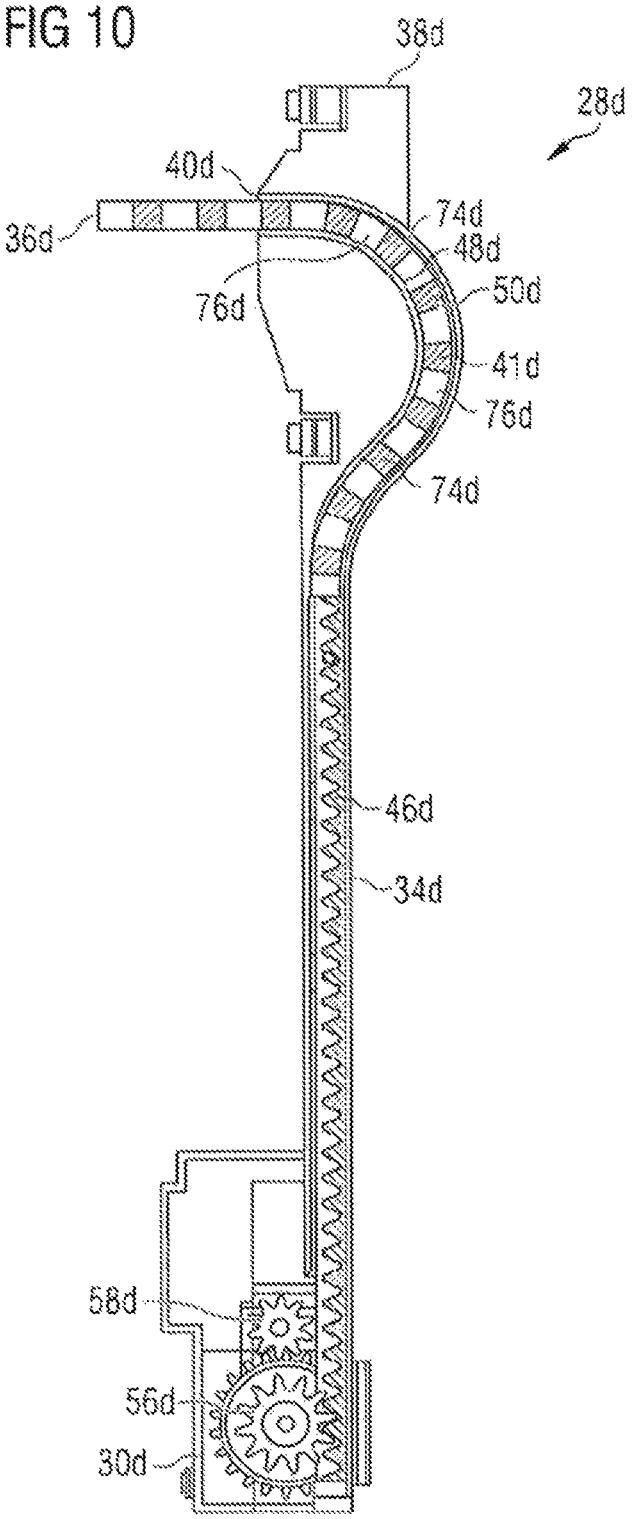

In the exemplary embodiment according to FIG. 10, the flexible section 41*d* of the push slider 34*d* is formed by a rod body 72*d* which is composed of a plurality of rubber-elastic part-bodies 74*d* and a plurality of part-bodies 76*d* which are rigid in compression, which part-bodies follow one another alternately in the rod body 72*d*. The rubber-elastic part-bodies 74*d* impart the necessary flexibility to the flexible section 41*d*, which allows the section 41*d* of the push slider 34*d* to follow the curved profile of the slideways 48*d*, 50*d*. The rod body 72*d* can be produced, for example, in a multi-component injection moulding process, so that the rubber-elastic part-bodies 74*d* and the part-bodies 76*d* which are rigid in compression are connected inseparably. The part-bodies 76*d* which are rigid in compression can be formed, for example, from a thermoplastic plastics material.

Figure 11:
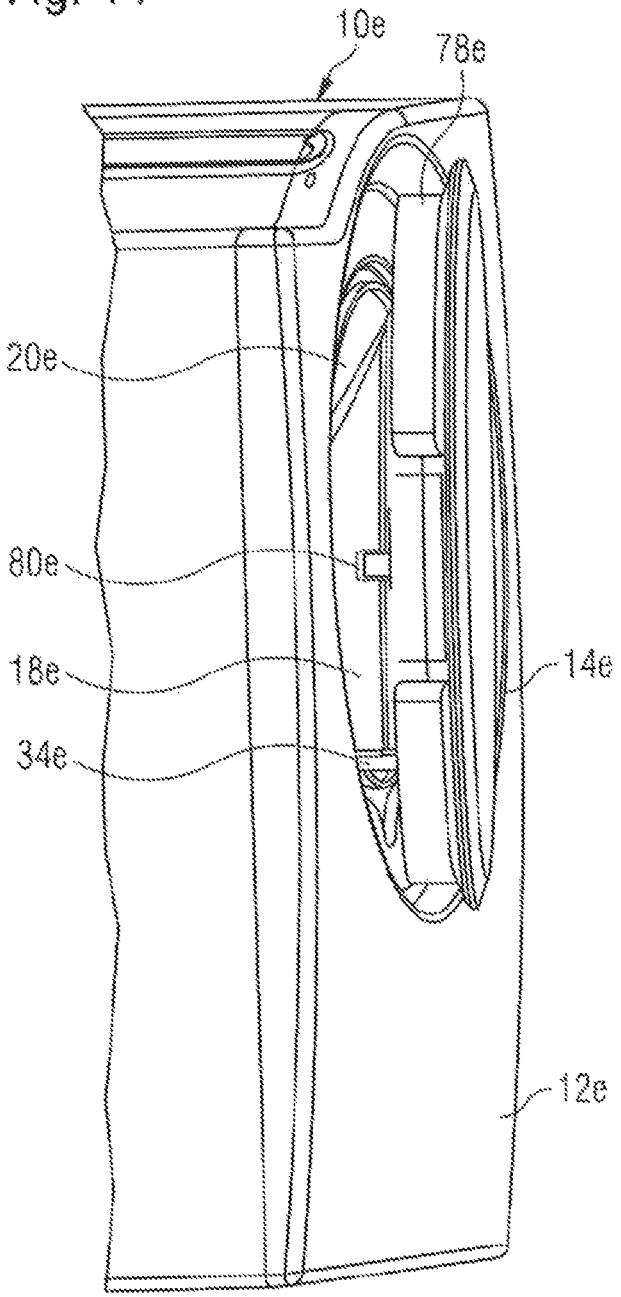
FIG. 11 is a perspective view of a detail of a domestic washing machine with a partially open door according to a further exemplary embodiment.

Reference will now be made to the exemplary embodiment according to FIGS. 11 and 12. This exemplary embodiment differs from the preceding exemplary embodiments inter alia in that the door-opening mechanism 28*e* is arranged not on the body 12*e* of the washing machine 10*e* (or of the domestic appliance in general), but on the door 14*e*. In FIG. 11, the push slider 34*e* of the door-opening mechanism 28*e*, as it protrudes from the door 14*e* on the side of the door facing the body 12*e*, can be seen. The door 14*e*, which as in the exemplary embodiment of FIG. 1 is in the form of a bull eye door, has a frame housing 78*e* surrounding the bull eye 18*e*, in which frame housing the door-opening mechanism 28*e* is accommodated. The frame housing 78*e* has an opening, not shown in greater detail, through which the push slider 34*e* projects at least in its deployed position (corresponding to the representation in FIG. 11). In its retracted position, the push slider 34*e* can be recessed completely inside the frame housing 78*e* of the door 14*e*. Alternatively, it is conceivable that the push slider 34*e* protrudes slightly from the frame housing 78*e*, and thus from the door 14*e*, also in its retracted position.

There can further be seen in FIG. 11 a closing body 80*e* which is arranged on the door 14*e* and in the example shown is in the form of a closing stirrup, which closing body is fixedly mounted on the door 14 and protrudes in the direction towards the body 12*e*. As the door 14*e* closes, the closing stirrup 80*e* comes into closing engagement with a latch assembly, arranged on the body 12*e*, of a door-closing mechanism (not shown in greater detail). The closing stirrup 80*e* is thereby caught, for example, between two gripping jaws of a rotatably arranged rotary member of the latch assembly, as shown, for example, in DE 10 2015 002 538

B3. It will be appreciated that in other embodiments the closing stirrup 80*e* can be mounted on the body 12*e* and the latch assembly with a suitable gripper for gripping the closing stirrup 80*e* can be arranged in the door 14*e*. As in the exemplary embodiment of FIG. 1, in the exemplary embodiment of FIGS. 11 and 12 too, the door-opening mechanism 28*e* and the door-closing mechanism are therefore assembly groups which are physically and mechanically separate from one another, which are functional independently of one another.

Provided that the frame housing 78*e* of the door 14*e* has a sufficient depth in its interior for a movement stroke of the push slider 34*e* of, for example, approximately 2 cm or approximately 3 cm, it is conceivable to configure the push slider 34*e*, unlike in the exemplary embodiments shown in the preceding figures, without a flexible section and instead to form the push slider 34*e* of a single, rigid body which is movable backwards and forwards only along a linear slide path. It is then not necessary to provide deflection in a curve as in the preceding exemplary embodiments. Such a form of the push slider 34*e* is shown in FIG. 12. The push slider 34*e* is there formed by a single slider body which is displaceable in a linear sliding direction which runs substantially perpendicularly to the door plane of the door 14. The push slider 34*e* is in intermeshing engagement with the pinion 56*e* arranged at the output-side end of the reduction gear 58*e* and, for that purpose, is designed with a toothed-rack region, not shown in greater detail. By rotation of the pinion 56*e*, the push slider 34*e* can consequently be moved forwards and backwards, depending on the direction of rotation of the pinion 56*e*.

Figure 12:
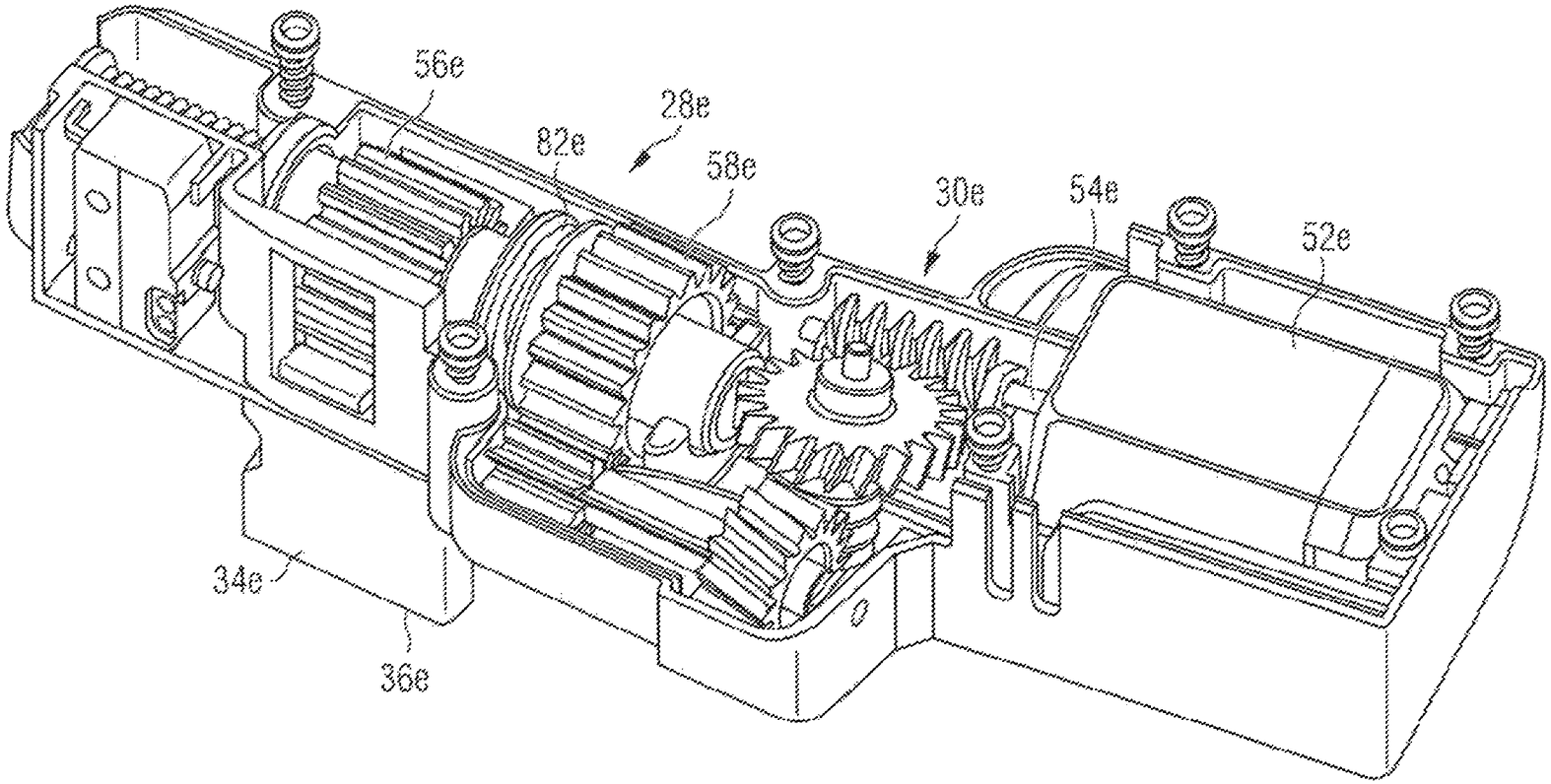
FIG. 12 is a perspective view of an example of a door-opening mechanism for installation in the door of the washing machine of FIG. 11.

In the exemplary embodiment of FIG. 12, part of the reduction gear 58*e* is a slip clutch 82*e*, which serves to prevent damage to the electric motor 52*e* if, on activation thereof, the push slider 34*e* is blocked against movement (e.g. because a user is inadvertently pushing against the door 14*e* with his legs, thus preventing it from opening). The slip clutch 82*e* acts as an overload clutch which, when a specific torque is reached, separates the power flow from the drive side to the output side of the slip clutch 82*e*.

Figure 13A:
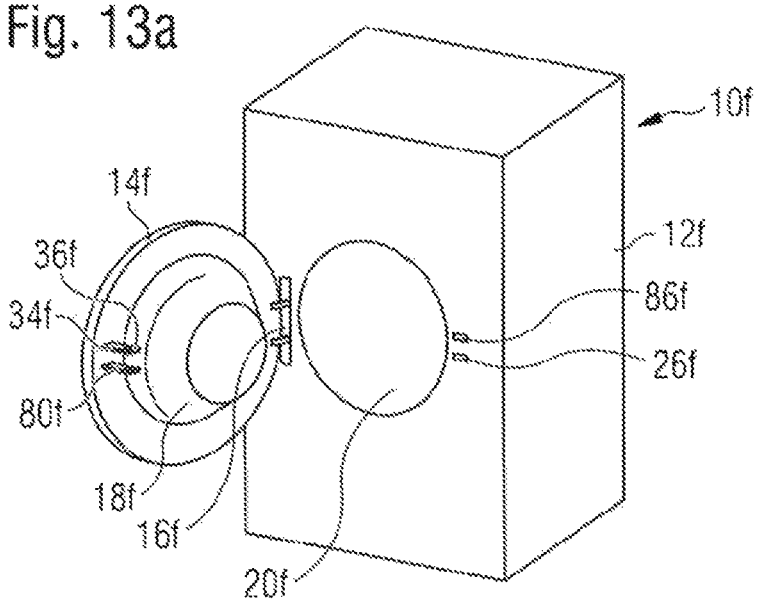
FIGS. 13*a* to 13*c* are different schematic views showing a domestic washing machine according to yet a further exemplary embodiment.
Figure 13B:
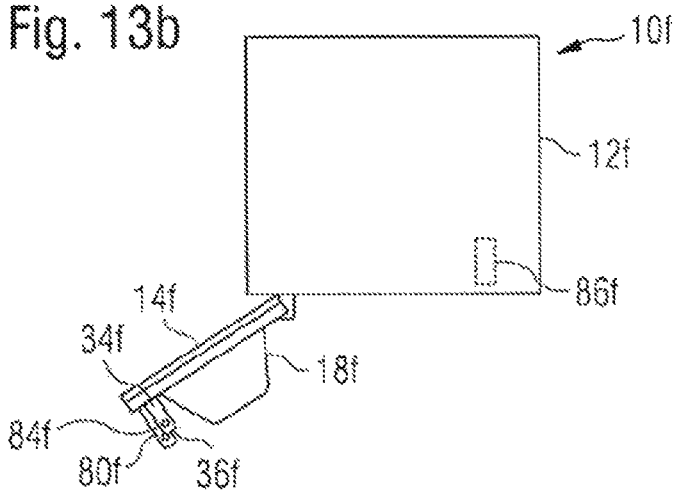
Figure 13C:
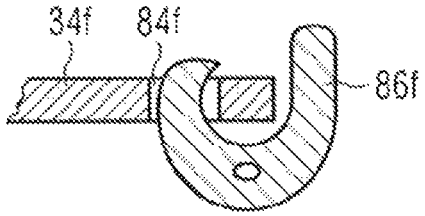

Finally, reference is made to the exemplary embodiment according to FIGS. 13*a* to 13*c*. In this exemplary embodiment of a domestic washing machine 10*f* of the front loader type too, a door-opening mechanism is arranged on the door 14*f*. FIGS. 13*a* to 13*c* show only the push slider 34*f* of said door-opening mechanism. The door-opening mechanism can be configured as in the exemplary embodiment according to FIGS. 11 and 12. However, in the exemplary embodiment according to FIGS. 13*a* to 13*c* the push slider 34*f* has a particular feature in that it is in the form of a closing stirrup with a stirrup opening 84*f*. A rotatable gripper 86*f* is arranged on the body opposite the push slider 34*f* (opposite when the door 14*f* is closed), which gripper moves into the stirrup opening 84*f* of the push slider 34*f* as the door 14*f* closes and thus grips and holds the push slider 34*f*. The situation of gripping engagement between the push slider 34*f* and the gripper 86*f* is shown schematically in FIG. 13*c*.

If, with the door 14*f* closed, the push slider 34*f* is moved out of its retracted position into the deployed position at the end of a wash program, in order to open the door 14*f* slightly, the gripping engagement according to FIG. 13*c* is maintained, that is to say the push slider 34*f* is not released from the gripper 86*f*. Maintaining the gripping engagement then allows the door 14*f* subsequently to be closed again by retraction of the push slider 34*f* from the deployed position into the retracted position.

The gripper 86*f* is a component which is physically and functionally separate from the door-closing mechanism 26*f*. In some embodiments, the door-closing mechanism 26*f* can contain a gripper of a similar form, which grips and holds the closing body 80*f* as the door 14*f* closes. However, unlike the gripper 86*f*, the gripper of the door-closing mechanism 26*f* can additionally be locked, at least in some embodiments, that is to say can additionally be locked in its gripping position, in which it grips and holds the closing body 86*f*, and thereby blocked against rotation back into a release position. Such a locking possibility is not required for the gripper 86*f* of the door-opening mechanism.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A domestic appliance comprising:

a body having an access opening to a process chamber arranged inside the body;

a door which is movably attached to the body and which frees the access opening in an open position and closes the access opening in a dosed position;

a door-closing mechanism for holding the door closed in its dosed position; and a door-opening mechanism having a push slider, which is arranged to be movable between a retracted position and a deployed position, and a drive unit for driving the push slider, wherein a transfer of the push slider out of the retracted position into the deployed position effects opening of the dosed door, wherein the push slider and the drive unit thereof are mounted on the door and the push slider protrudes from the door at least in the deployed position.

2. The domestic appliance according to claim 1, wherein the push slider is a component which is mechanically and physically separate from the door-closing mechanism.

3. The domestic appliance according to claim 1, wherein the push slider, on moving out of the retracted position into the deployed position, acts in a pressure-exerting manner on the body or on a component arranged on the body and thereby overcomes a holding-closed action of the door-closing mechanism and opens the dosed door.

4. The domestic appliance according to claim 1, wherein a gripping element which is mechanically and physically separate from the door-closing mechanism is arranged on the body, which gripping element maintains gripping engagement with the push slider when the door is closed and when the push slider is moved forwards out of the retracted position into the deployed position.

5. The domestic appliance according to claim 1, wherein the push slider is arranged to be movable along a slide path which is exclusively linear and runs in particular substantially perpendicularly to a door plane.

6. The domestic appliance according to claim 1, wherein the push slider has a toothed-rack region with which a rotary element of the drive unit is in intermeshing engagement.

7. A domestic appliance comprising:

a body having an access opening to a process chamber, in particular wet chamber, arranged inside the body, wherein the body forms a first main component of the domestic appliance;

a door which is movably attached to the body and which doses the access opening in a dosed position, wherein the door forms a second main component of the domestic appliance;

a door-closing mechanism for holding the door closed in its dosed position; and a door-opening mechanism arranged on one of the two main components and having a push slider, which is movable along a slide path between a retracted position and a deployed position, and a drive unit for driving the push slider, wherein the push slider, on moving out of the retracted position into the deployed position, acts in a pressure-exerting manner on the other of the two main components and thereby overcomes a holding-dosed action of the door-closing mechanism and opens the closed door, wherein the slide path has at least one curved portion, and at least a section of the push slider is in flexible form in order to follow the curved profile of the curved portion as the push slider moves along the slide path.

8. The domestic appliance according to claim 7, wherein the curved portion effects a change of direction of the sliding movement of the push slider by approximately 90 degrees.

9. The domestic appliance according to claim 7, wherein the flexibility of the section is due to elastic bendability or/and to articulation.

10. The domestic appliance according to claim 7, wherein the push slider has a leading portion, which moves out of one main component in a first direction when the push slider is transferred from the retracted position into the deployed position, and a rearward portion which performs a linear movement in a second direction running transversely, in particular perpendicularly, to the first direction when the push slider is transferred from the retracted position into the deployed position.

11. The domestic appliance according to claim 10, wherein the rearward portion is rigid compared to the flexible section of the push slider.

12. The domestic appliance according to claim 7, wherein the flexibility extends into a region of the push slider that protrudes from one main component in the deployed position.

13. The domestic appliance according to claim 12, wherein the flexibility extends over a major part of the length of a section of the push slider which protrudes from one main component in the deployed position.

14. The domestic appliance according to claim 7, wherein the door-opening mechanism forms in the curved portion a slideway on the inside of the curve and a slideway on the outside of the curve for guiding the push slider in a curve.

15. The domestic appliance according to claim 7, wherein the push slider has a toothed-rack element which is arranged in the force transmission path between the drive unit and the flexible section and is coupled in a push-transmitting manner with the flexible section, with which toothed-rack element a rotary element of the drive unit is in intermeshing engagement.

16. The domestic appliance according to claim 1, wherein the domestic appliance is a washing machine, a tumble dryer or a dishwasher.

17. The domestic appliance according to claim 7, wherein the domestic appliance is a washing machine, a tumble dryer or a dishwasher.

18. The domestic appliance according to claim 1, wherein the drive unit comprises a drive motor.

19. The domestic appliance according to claim 7, wherein the drive unit comprises a drive motor.

20. The domestic appliance according to claim 17, wherein a slip clutch is arranged in the force transmission path between a drive force generator of the drive unit and the push slider.

21. A domestic appliance comprising:

a body having an access opening to a process chamber arranged inside the body;

a door which is movably attached to the body and which closes the access opening in a closed position;

a door-closing mechanism for holding the door closed in its closed position;

a door-opening mechanism including a push slider, which is arranged to be movable between a retracted position and a deployed position, and a drive unit for driving the push slider, wherein the door, when in its closed position, can be opened through a transfer of the push slider out of the retracted position into the deployed position, wherein the push slider is configured to engage a gripping element, wherein the door can be closed through a transfer of the push slider from the deployed position into the retracted position while the push slider is in gripping engagement with the gripping element, wherein the push slider is a component which is mechanically and physically separate from the door-closing mechanism.

* * * * *